US005784902A

United States Patent [19]

Pinkowski et al.

[11] Patent Number: 5,784,902

[45] Date of Patent: Jul. 28, 1998

[54] AUTOMATIC WASHER AND LOAD RESPONSIVE AGITATOR THEREFOR

[75] Inventors: Robert J. Pinkowski, Baroda; Robert Harlan Nehrig, Stevensville, both of Mich.

[73] Assignee: Whirlpool Corporation, Benton Harbor, Mich.

[21] Appl. No.: 792,443

[22] Filed: Jan. 31, 1997

[51] Int. Cl.[6] ..... D06F 33/02

[52] U.S. Cl. ..... 68/12.02; 68/12.04; 68/133

[58] Field of Search ..... 8/159; 68/12.02, 68/12.04, 12.24, 133, 134, 23.3

[56] References Cited

U.S. PATENT DOCUMENTS

| | | | |
|---|---|---|---|
| 3,071,955 | 1/1963 | Platt et al. | 68/53 |
| 3,285,040 | 11/1966 | Bocham | 68/134 |
| 3,987,508 | 10/1976 | Platt | 8/159 |
| 3,987,651 | 10/1976 | Platt | 68/133 |
| 3,987,652 | 10/1976 | Ruble | 68/134 |
| 4,068,503 | 1/1978 | Platt | 68/133 |
| 4,164,130 | 8/1979 | Hammer | 68/133 |
| 4,195,500 | 4/1980 | Tobita et al. | 68/12.04 |
| 4,520,638 | 6/1985 | Brenner | 68/133 |
| 4,718,258 | 1/1988 | Mason et al. | 68/133 |
| 4,719,769 | 1/1988 | Pielemeier et al. | 68/133 |
| 4,920,770 | 5/1990 | Dooley et al. | 68/133 |
| 5,176,011 | 1/1993 | Imai et al. | 68/12.02 |
| 5,220,814 | 6/1993 | Imai et al. | 68/12.02 |
| 5,293,760 | 3/1994 | Tani et al. | 68/12.02 |

FOREIGN PATENT DOCUMENTS

| | | | |
|---|---|---|---|
| 59-67998 | 4/1984 | Japan | 68/133 |
| 60-137387 | 7/1985 | Japan | 68/133 |
| 61-238293 | 10/1986 | Japan | 68/12.04 |
| 62-122697 | 6/1987 | Japan | 68/12.04 |
| 5-49786 | 3/1993 | Japan | 68/12.02 |

*Primary Examiner*—Frankie L. Stinson
*Attorney, Agent, or Firm*—Thomas J. Roth; Joel M. Van Winkle; Robert O. Rice

[57] ABSTRACT

An automatic washer having an agitator that is responsive to the forces imparted to the agitator from a clothes load. The agitation comprises an auger, having an auger vane that is connected to a base having flexible vanes, by a force responder. Upon the imparting of a force from the clothes to the agitator, the auger translates relative to the base to relieve the force.

17 Claims, 4 Drawing Sheets

AUTOMATIC WASHER AND LOAD RESPONSIVE AGITATOR THEREFOR

BACKGROUND OF THE INVENTION

1. Field of the Invention

The present invention generally relates to an automatic washing machine with an agitator and specifically to an agitator that is responsive to forces imparted to the agitator by a clothes load.

2. Description of the Related Art

It is common in vertical axis automatic washers to use an agitator of some type to impart mechanical energy to a clothes load placed in the automatic washer to better clean the clothes load. Most contemporary vertical axis automatic washers have a wash tub in which is placed a perforated wash basket, which can be rotated by a motor. An agitator is disposed within the wash basket and is used to agitate the clothing placed in the wash basket.

Agitators can come in many different forms, such as a single action, double-action, and triple action. A single-action agitator is generally a one piece agitator that is driven in an oscillating motion by a motor. Most contemporary dual action agitators comprise an auger and a base. The auger is mounted to the base by a uni-directional clutch so that the auger rotates only during forward rotation of the oscillating agitator base. The auger generally has a corkscrew-like vane about its perimeter for driving the clothes downward toward the base during the forward rotation of the agitator. The base has multiple flexible vanes for imparting mechanical energy to the clothing and inducing rollover to the clothing. Clothing rollover is considered as a measure of washing efficacy in the industry. The auger generally rotates in a single direction about the vertical axis whereas the base generally oscillates. Most triple-action agitators are similar to dual-action agitators in that they comprise a rotating auger in combination with an oscillating base. In addition, the triple-action agitator auger is directly driven in a reciprocating motion in addition to its rotational motion to further impart mechanical energy to the clothes load.

All agitators, especially the dual-action agitators, are subject to the occasional relatively large forces from the clothes load contacting the agitator as it attempts to agitate the clothing. Generally, the large forces are created by the clothing collecting mostly in one location on the agitator during agitation, or when a user puts an inordinate amount of clothing into the automatic washer. In the dual-action agitator, the auger vane during the drive direction drives the bunched clothes load or the overload of clothing, down onto the oscillating vanes, effectively binding the clothing between the auger vane and the flexible vanes, resulting in unusually large forces acting on the auger vane and the flexible vanes. Over time, these large forces can cause the failure of the auger vane, flexible vanes, and other parts of the agitator along with clothes damage. Therefore, it is desirable to eliminate these forces and relieve the agitator and clothes load from the effects of these forces. It is also desirable to impart a downward pressure on the clothes load in both the forward and backward directions of the agitator base, unlike current dual actions that only impart downward pressure in the forward direction.

SUMMARY OF THE INVENTION

The invention overcomes the effects of these forces by using an agitator that is responsive to the large forces to relieve the agitator from these forces. In essence, the agitator senses the presence of the large forces by moving the agitator to relieve the large forces. The agitator, according to the invention, comprises an auger, which is adapted to be driven by a drive means of an automatic washer. A force responder is connected to the auger and the drive means so that the force responder permits the auger to respond to the forces imparted by a clothes load contacting the auger in such a manner to relieve the forces on the auger.

Preferably, the force responder is a spring, shock absorber, or other type of force responding device connecting the auger to the drive means, such as the drive shaft of an electric motor or the base of the agitator. The force responder permits the auger to translate with respect to the drive means. Therefore, when the clothes load imparts a sufficiently large force to the auger, the forces will overcome the biasing force of the force responder resulting in the translation of the auger to relieve the forces from the clothes load on the auger. The biasing force downward of the force responder tends to return the auger to its original position while applying a reaction force to the clothes load to move the clothes load away from the auger and toward the base to induce rollover. This reactionary downward force is applied to the clothes load during the backward direction of the agitator vanes and base, thus inducing more rollover on large loads due to the downward force now being applied in the forward and backward direction of the agitator vanes.

BRIEF DESCRIPTION OF THE PREFERRED EMBODIMENTS

Figure 1:
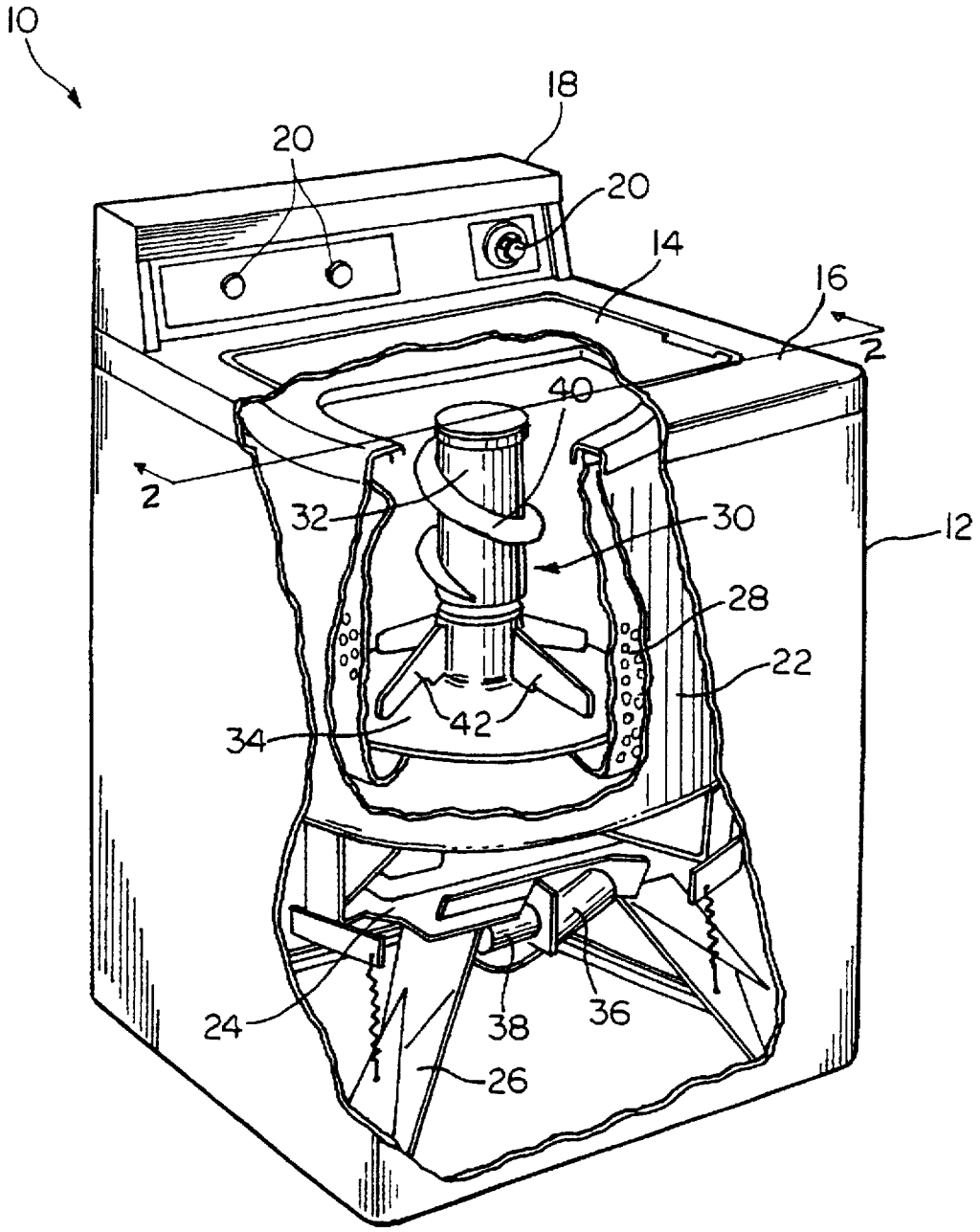
FIG. 1 is a cutaway perspective view showing an automatic washer and agitator according to the invention.
Figure 2:
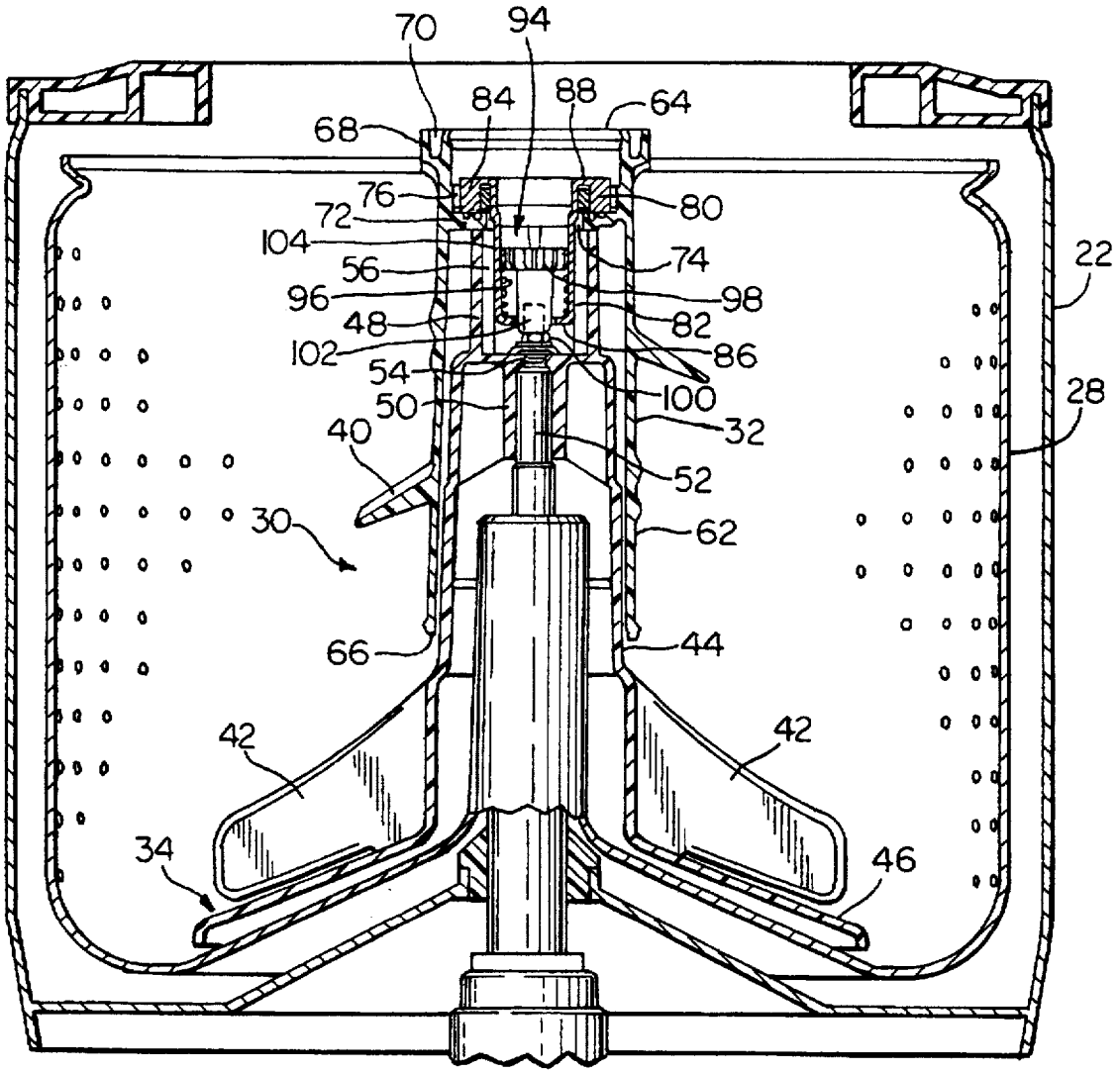
FIG. 2 is a sectional view taken along line 2—2 of FIG. 1 illustrating the agitator construction and its relationship to the automatic washer.
Figure 3:
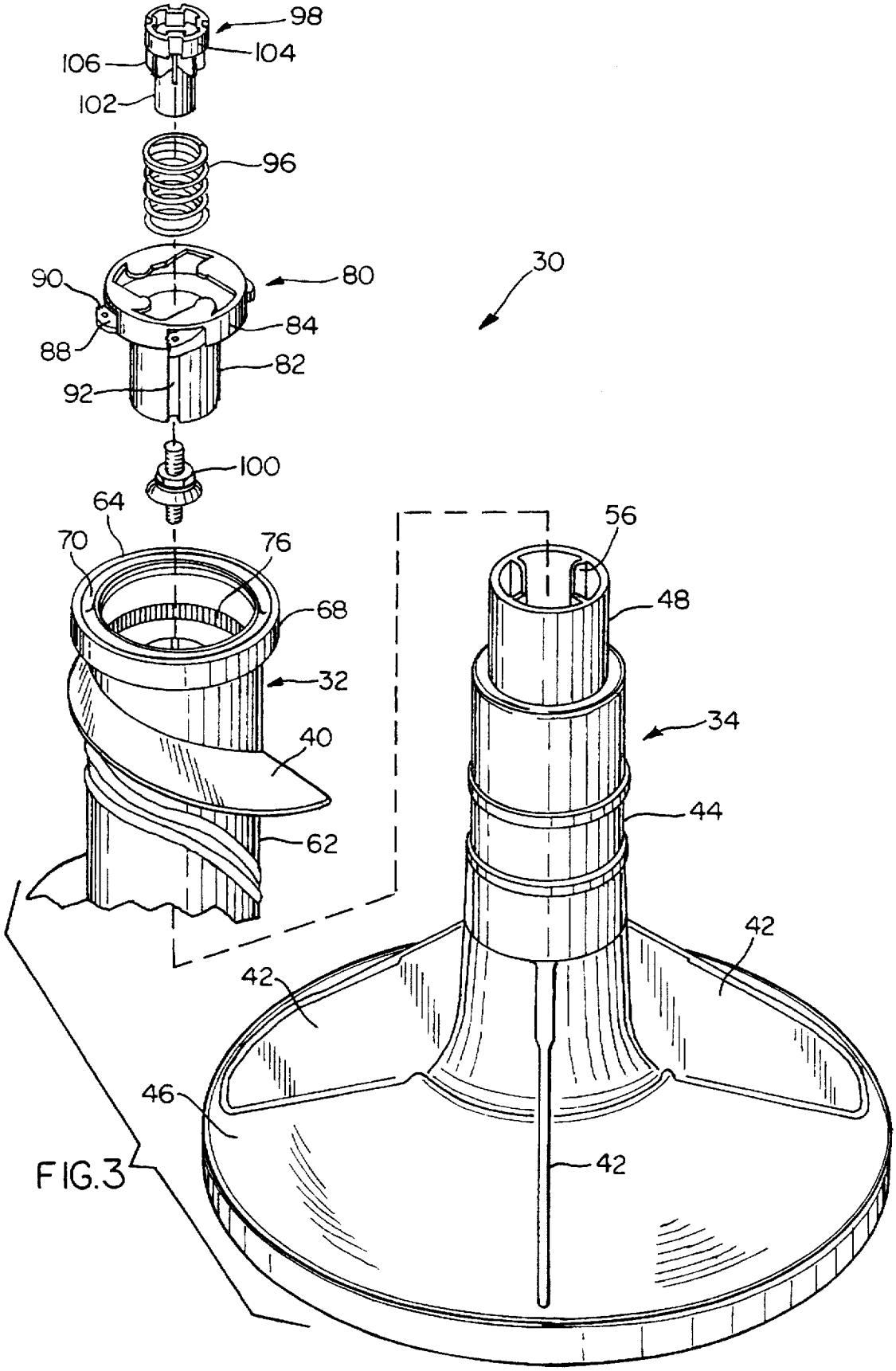
FIG. 3 is an exploded view of the agitator illustrated in FIGS. 1 and 2.
Figure 5:
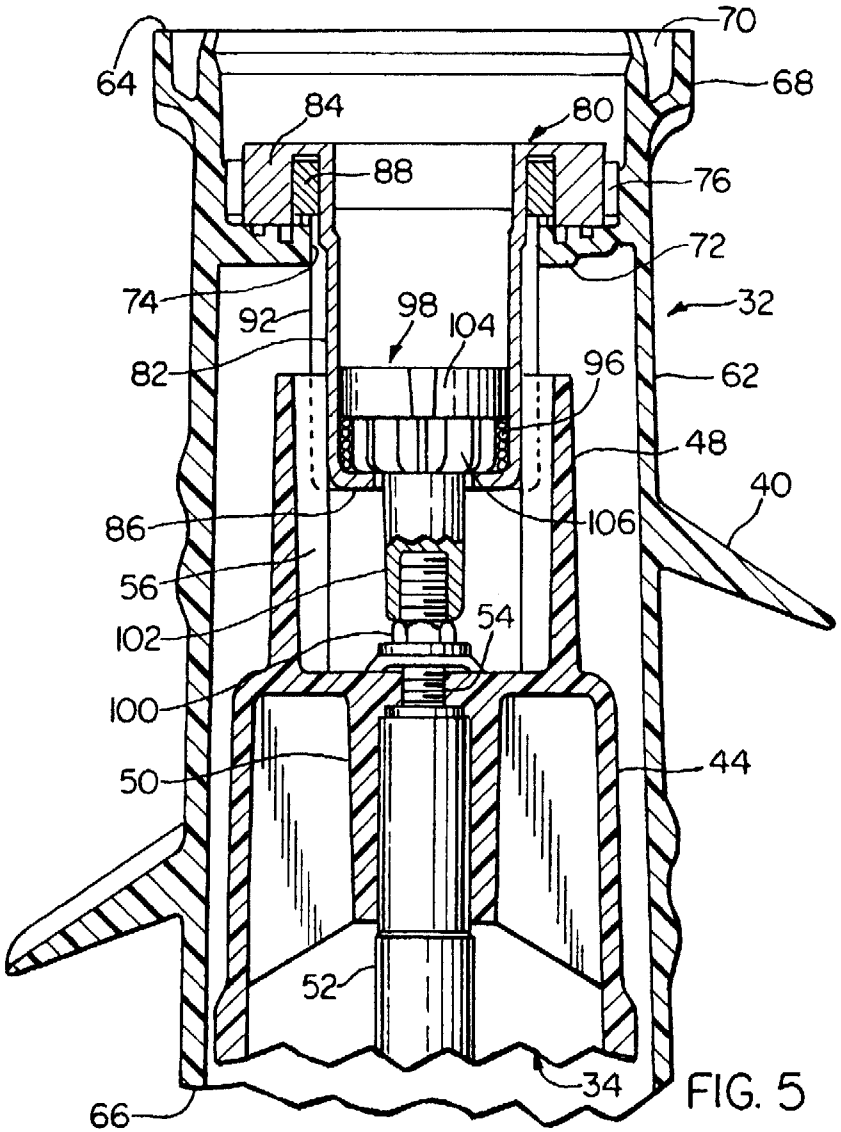
FIG. 5 is similar to FIG. 4, but the auger is translated from the normal position.
Figure 4:
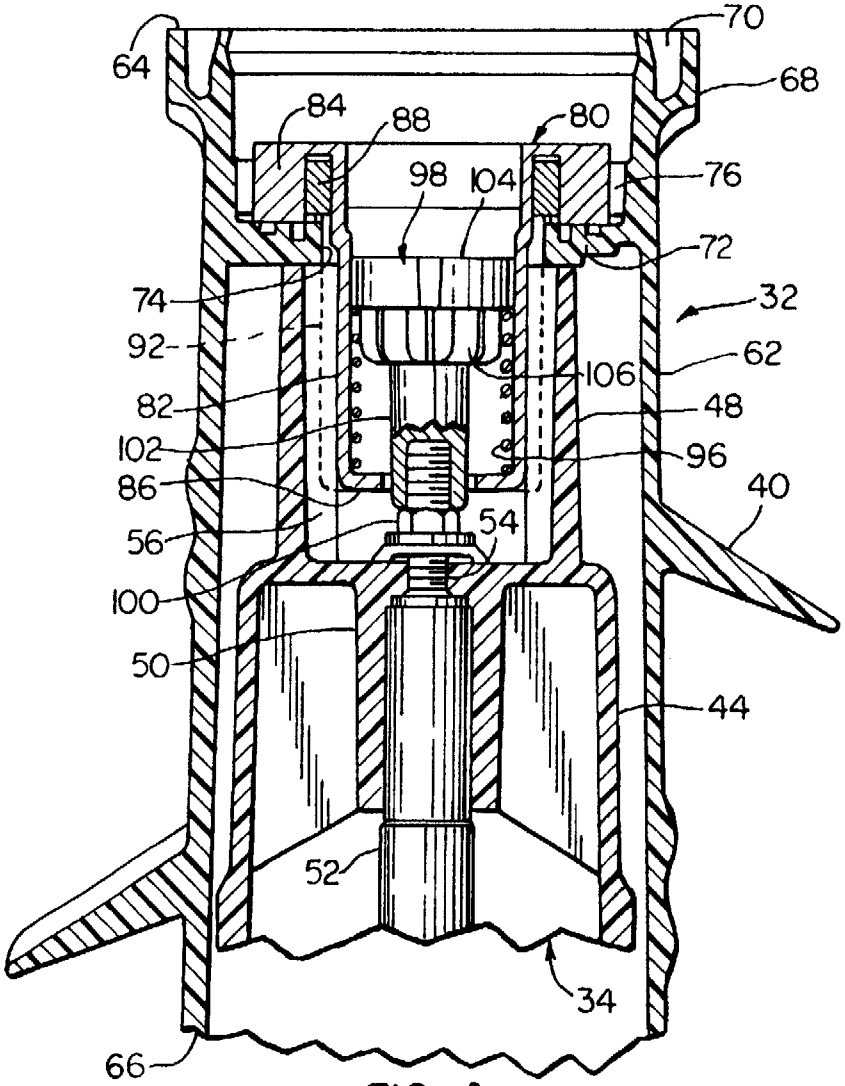
FIG. 4 is an enlarged view of the agitator of FIG. 2 with the auger in the normal position.

FIG. 1 illustrates an automatic washing machine 10 according to the invention. The automatic washer 10 includes a cabinet 12 having an openable door 14 in a top panel 16 of the cabinet 12. A control console 18 is provided along the rear edge of the cabinet 12 and includes a plurality of pre-settable controls 20 for automatically controlling various laundry cycles selected by the user, such as the washing, rinsing, and drying periods.

An imperforate wash tub 22 is mounted within the cabinet 12 and supported on a base 24 connected to the cabinet 12 by multiple support legs 26. A perforated wash basket 28 is disposed within the wash tub 22. The wash basket 28 defines a treatment zone in which a clothes load is placed for cleaning.

A load responsive agitator 30 is positioned within the wash basket 28. The agitator 30 comprises an auger 32 and a base 34. A motor 36 and its associated transmission 38 are mounted to the base 24 and are used to drive the wash basket 28, auger 32, and base 34. Generally, the wash basket is spun at relatively high speeds when there is a need to remove water from the clothes load. The base is typically oscillated between a forward and reverse rotation and the auger is typically rotated in a single direction.

Referring to FIGS. 2–5, the agitator 30 according to the invention is described in greater detail. Looking at the exterior of the auger 32, it can be seen that it has an auger vane 40 extending helically along the cylindrical exterior of the auger 32. Similarly, the base 34 has multiple, radially spaced flexible vanes 42. During operation of the agitator, the auger vane 40 tends to drive clothing downward toward the base 34 whose flexible vanes 42 direct the clothing outwardly toward the wall of wash basket 28. The clothing then moves to the top of the water where it is drawn back toward the auger by the auger vane 40 and the process is repeated. The action of the clothing being drawn inwardly toward the auger down toward the flexible vanes and then moving upwardly toward the surface of the water and then repeating itself is known as rollover, an action which is believed to enhance the cleaning capabilities of the automatic washer.

Looking more closely at the internal structure of the agitator 30, it can be seen that the agitator base 34 comprises a column 44 that terminates in a flared portion or skirt 46, at one end, and a collar 48, at the other end. The agitator base 34 has a hollow interior, which defines a passageway extending from the skirt 46, into the column and through the collar 48. A mounting lug 50 is formed within the hollow interior of the column and is adapted to receive the end of a drive shaft 52 extending from the transmission 38 (FIG. 1). The drive shaft 52 is press fit within the mounting lug 50 and has a topped end that aligns with an opening 54 in the mounting lug 50. Spline projections 56 are disposed on the hollow interior of the collar 48.

The auger 32 has a generally hollow cylindrical body 62 from which extends the auger vane 40. The opposing ends 64 and 66 of the auger are open. The end 64 terminates in a collar 68, which defines an annular groove 70, which is adapted to receive a cap or a reservoir (not shown) for receiving and distributing wash additives. The other end 66 is adapted to be slideably mounted over the column 44 of the agitator base 34. An annular flange 72 extends inwardly from the tubular body 62 and defines an opening 74. An annular ring of gear teeth 76 are formed in the inner wall of the tubular body 62 above the annular flange 72.

The auger 32 is coupled to the base 34 by a unidirectional drive mechanism, such as one-way clutch 80. The one-way clutch 80 is well known in the automatic washer field and will only be described generally. For the invention, it is not that important what type of uni-directional drive is used. The one-way clutch 80 comprises a tubular shaft 82 having a head 84, which defines a passage extending through the shaft 82 and the head 84. Both the shaft 82 and the head 84 have a cylindrical outer face. The end of the shaft 82 opposite the head 84 is partially closed by an annular flange 86. Multiple cams 88 are pivotally mounted, at one end, to the head 84 within slots in the cylindrical outer face of the head 84 and have gear teeth 90 on their other end. Multiple spline grooves 92 are formed in the exterior of the shaft 82.

When the agitator 30 is assembled, the shaft 82 of the one-way clutch 80 is inserted through the opening 74 defined by the annular flange 72 of the auger 32, until the head 84 of the one-way clutch 80 abuts the annular flange 72. When assembled, the spline projections 56 on the interior of the collar 48 of the agitator column 44 are received within the spline grooves 92 of the shaft 82 of the one-way clutch 80 to fix the rotational position of the one-way clutch with respect to the agitator column 44. In this position the teeth 90 of the cams 88 are adapted to enmesh with the gear teeth 76 formed on the inner wall of the tubular body 62 of the auger 32 in response to movement of the base in only one of its oscillating directions.

A force responder 94 couples the one-way clutch 80 to the drive shaft 52 and thus couples the auger 32 to the drive shaft 52. The force responder 94 comprises a coil spring 96, a retainer 98 and a fastener 100. The retainer has a tapped stem 102, which terminates in a head 104 having an outer diameter approximately equal to the inner diameter of the shaft 82 of the one-way clutch 80. A plurality of fins 106 extend from the bottom of the head to the stem 102 and define an outer diameter that is approximately the same size as the inner diameter of the coil spring.

To couple the auger to the drive shaft, the stem 102 and the fins 106 are slideably mounted into the interior of the coil spring 96 to press fit one end of the coil spring 96 onto the retainer 98. The combined retainer and coil spring are then inserted into the central opening in the one-way clutch 80 where one end of the coil spring 96 abuts the annular flange 86. The retainer 98 is then depressed against the force of the coil spring 96 until the internally threaded stem 102 extends through the opening defined by the annular flange 86. One end of the fastener 100 is then threaded into the threaded opening of the mounting lug 50.

Advantageously, the head 104 of the retainer 98 is formed with a shaped recess that is adapted to receive a tool so that the retainer 98 can be turned by the tool to thread the fastener 100 into the threaded opening of the mounting lug 50. As an alternative to first securing the fastener 100 to the retainer 98, the fastener 100 can be threaded into the threaded opening of the mounting lug 50 by using a tool that engages the nut head on the retainer. Then, the internally threaded stem 102 of the retainer 98 is aligned with the other end of the fastener 100 and threaded thereon by use of a tool received in the shaped opening of the head 104 of the retainer 98.

In operation, the agitator base 34 is oscillated between forward and reverse rotational directions by the drive shaft extending to the transmission, which is coupled to the motor of the drive means. The one-way clutch 80 converts the oscillating motion of the agitator base 34 into a stepped one-way rotation for the auger 32. Usually the auger 32 rotates (driven) when the base rotates forwardly. In this manner, the auger continues to rotate in one direction as the base continues oscillating between the forward and reverse rotations.

As described previously, the one-way rotation of the auger pulls clothing near the top of the water in toward the auger and directs it downwardly onto the vanes of the oscillating agitator base 34. The agitator base 34 directs the clothing downwardly and then outwardly toward the peripheral wall of the wash basket where the clothing is directed upwardly toward the top of the water by its buoyancy and the force of the other following clothing items. The process is then repeated.

If during the wash process, the clothing happens to collect near the auger or an overload of clothing is placed into the wash basket, the auger will attempt to drive the clothing collection or overload of clothing downwardly onto the oscillating flexible vanes of the agitator base, resulting in the potential binding of the auger and the base. When the binding forces created by the bound clothing load become greater than the spring force of the coil spring 96, the coil spring compresses, which permits the auger 32 to translate in a vertical direction away from the oscillating base plate to relieve the auger, base plate and the clothes load from the undesirably high forces (FIG. 3), reducing the potential for damage to the auger, base plate and clothes load.

Advantageously, the spring force of the force responder continues to impart a reactive force onto the clothing, driving them downwardly onto the oscillating flexible vanes. The spring force is applied during both the forward and backward rotation of the base. The reactive force insures that the general rollover action of the clothing will continue even while the auger is relieving the agitator from the unusually large load forces associated with the clothing load. In essence, the agitator 30 through the auger 32 is able to react or respond to the size of the clothing load placed within the wash basket, even if the clothing collects during washing, to prevent the clothes load from binding between the auger and base plate and imparting a potentially detrimentally large force to the agitator or clothing load that would negatively impact the reliability of the agitator or the wash performance of the automatic washer and possibly damage the clothing load. The invention also effectively increases the maximum wash load that can be placed within the wash basket while still maintaining the desired rollover.

The invention solves the problem of a clothing load binding between the auger and the baseplate of an agitator, resulting in the imparting of a potentially detrimental force to the auger base plate or clothing load. Although the invention is illustrated in the context of a dual-action agitator, it is applicable to many other types of agitators.

We claim:

1. An agitator for an automatic washer having a drive means including a motor for rotating a vertical drive shaft, the agitator comprising:

an auger adapted to be driven by the drive shaft, and a force responder connected to the auger and the drive means whereby the force responder permits translational movement of the auger relative to the drive shaft in response to the forces imparted by a clothes load contacting the auger.

2. An agitator as claimed in claim 1, wherein the drive means further includes a uni-directional drive connecting the auger to the drive shaft to permit one-way rotational movement of the auger.

3. An agitator as claimed in claim 2, wherein the uni-directional drive is a one-way clutch.

4. An agitator as claimed in claim 3, wherein the force responder comprises a spring having opposing ends with one end of the spring fixed relative to the drive shaft and the other end of the spring mounted to the auger.

5. An agitator as claimed in claim 4, wherein the spring is a coil spring and the force responder further comprises a retainer comprising a head abutting the one end of the coil spring and a stem extending through the coil spring and secured to the drive shaft whereby when the auger encounters a force greater than the spring force imparted by a contacting clothes load, the auger will move to relieve the load on the agitator while still applying a reactive force to a clothes load.

6. An agitator as claimed in claim 1, wherein the drive means comprises the motor with the drive shaft and a base mounted to the motor, and the force responder mounts the auger to the base to permit translational movement of the auger relative to the base in response to the forces imparted by a clothes load contacting the auger.

7. An agitator as claimed in claim 6, wherein the drive means further includes a uni-directional drive connecting the auger to the drive shaft.

8. An agitator as claimed in claim 7, wherein the uni-directional drive is a one-way clutch.

9. An agitator as claimed in claim 6, wherein the agitator oscillates between a forward and backward rotation and the force responder applies a responsive force to the clothes load during both the forward and backward rotations.

10. An agitator as claimed in claim 1, wherein the force responder comprises a spring having opposing ends with one end of the spring fixed relative to the drive shaft and the other end of the spring mounted to the auger.

11. An agitator as claimed in claim 10, wherein the spring is a coil spring and the force responder further comprises a retainer comprising a head abutting the one end of the coil spring and a stem extending through the coil spring and secured to the drive shaft whereby when the auger encounters a force greater than the spring force imparted by a contacting clothes load, the auger will move to relieve the load on the auger while still applying a reactive force to a clothes load.

12. An agitator for an automatic washer comprising a motor having a drive shaft, the agitator comprising:

a base mounted to a drive shaft;

an auger;

a uni-directional drive engaging the auger; and a force responder connecting the uni-directional drive to one of the drive shaft and the base, wherein the force responder permits the translational movement of the auger in response to forces imparted to the auger by a contacting wash load.

13. An agitator as claimed in claim 12, wherein the uni-directional drive is a one-way clutch.

14. An agitator as claimed in claim 12, wherein the force responder comprises a spring having opposing ends with one end of the spring fixed relative to the drive shaft and the other end of the spring mounted to the auger.

15. An agitator as claimed in claim 14, wherein the spring is a coil spring and the force responder further comprises a retainer comprising a head abutting the one end of the coil spring and a stem extending through the coil spring and secured to the drive shaft whereby when the auger encounters a force greater than the spring force imparted by a contacting clothes load, the auger will move to relieve the load on the agitator while still applying a reactive force to a clothes load.

16. An agitator as claimed in claim 12, wherein the agitator oscillates between a forward and backward rotation and the force responder applies a responsive force to the clothes load during both the forward and backward rotations.

17. An automatic washer comprising:

a motor having a drive shaft; and an agitator comprising:

a base mounted to a drive shaft;

an auger;

a uni-directional drive engaging the auger; and a force responder connecting the uni-directional drive to one of the drive shaft and the base, wherein the force responder permits the translational movement of the auger in response to forces imparted to the auger by a contacting wash load.

* * * * *